US006957686B2

(12) United States Patent
Puffer, Jr. et al.

(10) Patent No.: US 6,957,686 B2
(45) Date of Patent: Oct. 25, 2005

(54) HEATED BLADES FOR WAX MELTING

(75) Inventors: Raymond H. Puffer, Jr., Watervliet, NY (US); Bruce S. Phipps, Millbrook, NY (US); Daniel Walczyk, Brunswick, NY (US); Rory Mackean, Jaffrey, NH (US); Jason Chalfant, Troy, NY (US); Keith F. Hendrck, Modena, NY (US)

(73) Assignee: MPI Incorporated, Poughkeepsie, NY (US)

( * ) Notice: Subject to any disclaimer, the term of this patent is extended or adjusted under 35 U.S.C. 154(b) by 28 days.

(21) Appl. No.: 10/601,932

(22) Filed: Jun. 23, 2003

(65) Prior Publication Data

US 2004/0256076 A1 Dec. 23, 2004

(51) Int. Cl.[7] ..... B22C 7/00

(52) U.S. Cl. ..... 164/45; 164/35; 164/412; 219/229; 228/51

(58) Field of Search ..... 164/35, 45, 412; 228/51–55; 219/229

(56) References Cited

U.S. PATENT DOCUMENTS

| | | | | | |
|---|---|---|---|---|---|
| 3,084,649 | A | * | 4/1963 | Parstorfer | 228/19 |
| 3,943,323 | A | * | 3/1976 | Smith et al. | 219/85.1 |
| 4,081,658 | A | * | 3/1978 | Ammann | 219/233 |
| 4,090,656 | A | * | 5/1978 | Sato et al. | 228/180.1 |
| 6,039,241 | A | * | 3/2000 | Tucker et al. | 228/264 |
| 2002/0023909 | A1 | * | 2/2002 | Usui | 219/236 |
| 2003/0098136 | A1 | * | 5/2003 | Ludwig et al. | 164/35 |

* cited by examiner

*Primary Examiner*—Kuang Y. Lin
(74) *Attorney, Agent, or Firm*—Heslin Rothenberg Farley & Mesiti P.C.

(57) ABSTRACT

A knife for heating the wax on the surface of a wax runner. The knife as a surface which is recessed in the center of the surface to permit melted wax to flow up into the recessed area and not flow away from the knife. Alternately, conformal heating surface which melts only that portion of the wax runner to which the pattern gate is affixed. Additionally an electrical circuit is provided which includes a heater and a temperature controller to limit the temperature at which wax is melted.

7 Claims, 5 Drawing Sheets

FLAT
SECTION 7-7

GROOVED
SECTION 9-9

HEATED BLADES FOR WAX MELTING

BACKGROUND

1. Field of the Invention

This invention relates to the production of wax trees for casting and, more particularly, to the design of blades or knives for heating wax runners and wax pattern gates to attach the wax pattern gate to a wax runner.

2. Prior Art

The Lost Wax Process is a long established process for casting. In the practice of the Lost Wax Process a wax pattern of a part to be cast is molded in wax. When the wax pattern is molded, a pattern gate is molded with the wax pattern in one piece. Wax runners are also molded separately. Wax runners are usually at least one branch frequently with flat surfaces and two ends. Some wax runners have a circular cross section and thus do not have either flat surfaces or edges. At one end of the runners there is a head and the other end there is a tail. A pour cup may be located at the head. The wax pattern gates are affixed to the wax runners to form a wax tree. To do this both ends of the wax pattern gate and the surface of the wax runner need to be heated sufficiently to melt wax to permit fusion. Once the wax patterns are affixed to the wax runner, a wax tree has been formed, and then ceramic material is placed on the wax tree. Once the ceramic has hardened it is heated causing the wax to flow out of the ceramic. The ceramic thus forms a mold into which the molten metal is poured to produce the desired part.

In recent times, much of the Lost Wax Art has been substantially automated. In the patent application of Ludwig, et al, entitled Process and Apparatus for the Assembly of Wax Trees, Ser. No. 10/304,840, assigned to the same assignee, an advanced process and apparatus is taught for automating the fusion of wax gates of wax patterns 5 to a wax runner. A heated blade is used to heat the pattern gates and the wax runner. The heated blade, the pattern gates and the wax runner are all operated by robotics. However, the fusion of wax pattern gates to a wax runner has been traditionally a manual operation performed by heating putty knives on a Bunsen Burner to melt the surface of the wax runner and the end of the pattern gate.

In the automated process, the wax runners are held by a head stock and a tail stock in a runner station. The wax runner is also heated in the automated process so that a plurality of wax patterns can be affixed to the wax runner at one time.

Maintaining a wax runner in a perfectly flat position when attaching the wax patterns is a most desirable goal, but unfortunately is not readily attainable. As a result, portions of the wax runner are penetrated more deeply by the heated blade than other portions. Excess molten wax is a result of excessive melting, and should the excessive melted wax run over the side of the wax runner, the wax runner and the wax patterns attached to it are not useable resulting in lost product.

In heating the wax gate and the wax runner, the temperatures of heating the wax can become sufficiently high as to exceed the flash point of the wax causing it to give off fumes which are considered to be a health hazard.

Therefore, it is highly advantageous to provide a blade for heating the wax runner which prevents molten wax from running over the edge of a wax runner, and it is also highly desirable to control the temperature of melting of the wax gate and wax runner to avoid the emission of fumes.

Therefore, the objects of this invention are to provide the following:

a knife for melting wax on a wax runner which prevents molten excess wax from flowing over the side of the wax runner by providing space in the surface of the knife to retain molten wax.

a knife which conforms the heated area to the configuration of the end of the wax gate of the wax pattern, to eliminate the melting of unnecessary wax.

a knife which reduces the incidence of lost wax trees.

a knife which is economical to produce and which is durable and dependable.

a knife whose temperature is controlled to prevent the formation of undesirable fumes by maintaining the temperature of the knife below the flash point temperature of the wax.

SUMMARY OF THE INVENTION

A knife is provided which has two opposite sides. The knife further includes an elongated bar of heat-conducting material that has two opposed and generally parallel surfaces. One surface is for contacting the pattern gate and the other is for contacting the wax runner. The surface for contacting the wax runner has two side edges and a center section between the two side edges. At least a portion of the center section, whether grooved or concave, is slightly closer to the opposite surface.

As an alternative, in place of the grooved or concave surface, a series of raised conformal surfaces are located to heat only that portion of the wax runner where the pattern gate will be placed.

The knife further includes a means for heating the elongated bar.

DETAILED DESCRIPTION OF THE DRAWINGS

DESCRIPTION OF THE NUMERALS

| Numeral | Description |
|---|---|
| 11 | Wax Pattern |
| 13 | Wax Runner |
| 14 | Wax Pattern Gate |
| 15 | Pattern Holder |
| 17 | Pour Cup |
| 19 | Head |
| 21 | Knife |
| 22 | Surface (Contact Runner) |
| 23 | Surface (Contact Gate) |
| 27 | V-shaped Groove |
| 29 | Edge |
| 31 | Concave Surface |
| 33 | Sides |
| 35 | Conformal Surface |
| 36 | Grooves |
| 37 | Base Surface |
| 39 | Heating Element |
| 41 | Temperature Sensor |
| 43 | A-C Power Supply |
| 45 | Circuit Breaker |
| 47 | Temperature Controller |
| 51 | Solid State Relay |
| 53 | Solid State Contact |

DETAILED DESCRIPTION OF THE PREFERRED EMBODIMENT

Figure 1:
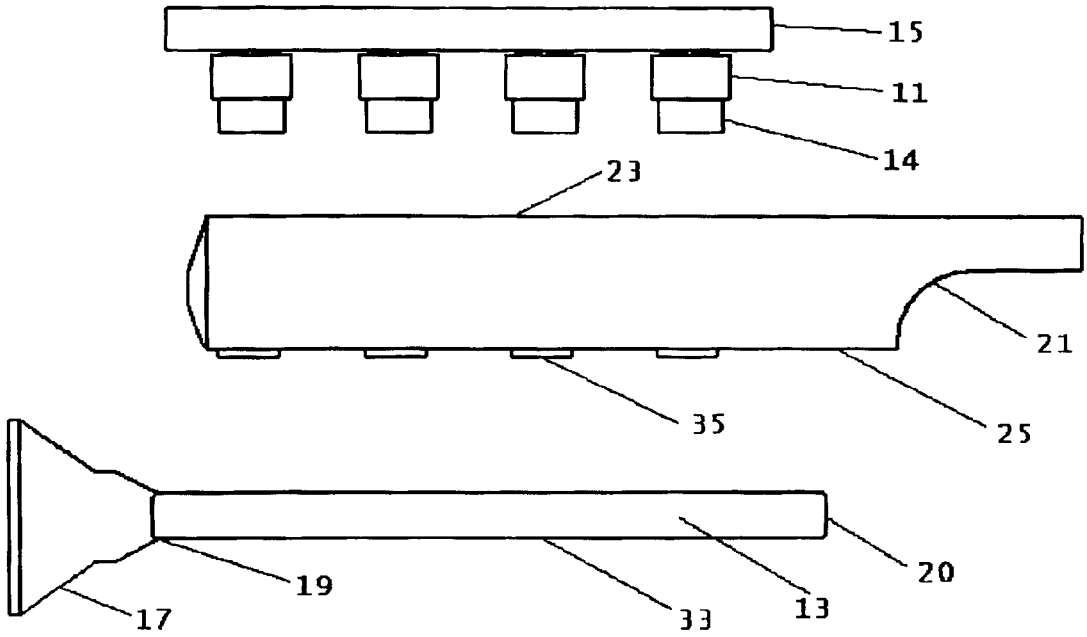
FIG. 1 is a side elevation showing wax patterns with pattern gates being held in a fixture on one side of a knife with a wax runner on the opposite side of the knife, with the knife including conformal contact areas.

Referring now to FIG. 1, the general relationship is shown between wax patterns 11 and a wax runner 13. The wax patterns include wax pattern gates 14. The wax patterns 11 are held by a pattern holder 15. The wax runner 13 with a pour cup 17 at the head 19 is located beneath the wax patterns 11. A knife 21 having conformal surfaces in accordance with this invention as will be hereinafter explained is located between the wax patterns 11 and the wax runner 13. After both the wax pattern gates 14 of the wax patterns 11 and the wax runner 13 are heated by the knife 21, which is temporarily interposed between the wax patterns 11 and the wax runner 13, the knife 21 is withdrawn and the wax pattern gates 14 are brought into contact with the wax runner 13 to create fusion.

Figure 2:
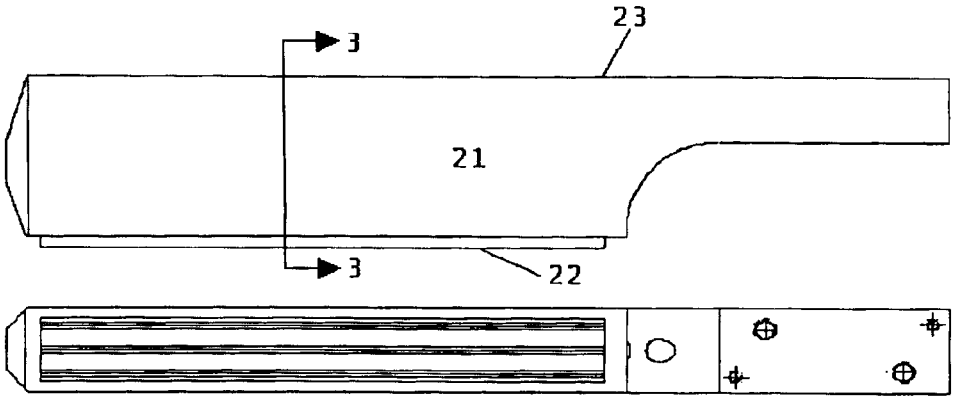
FIG. 2 is a plan view of the base of a knife having an elongated groove pattern.
Figure 4:
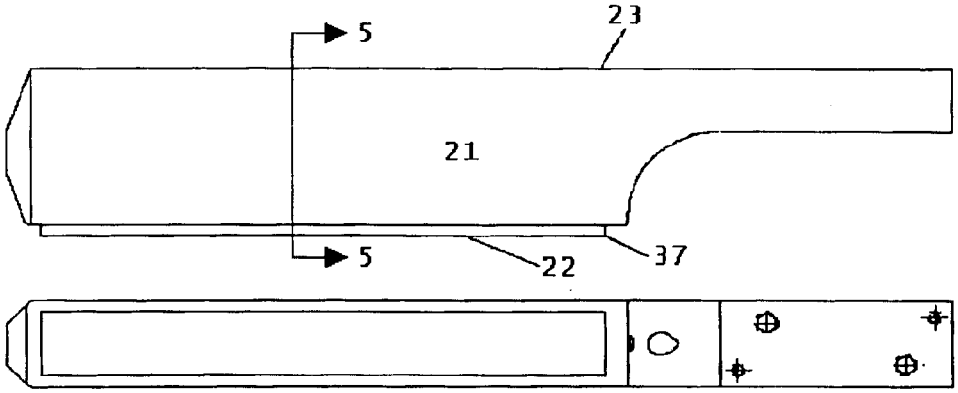
FIG. 4 is a plan view similar to FIG. 2 but with a concave pattern.
Figure 3:
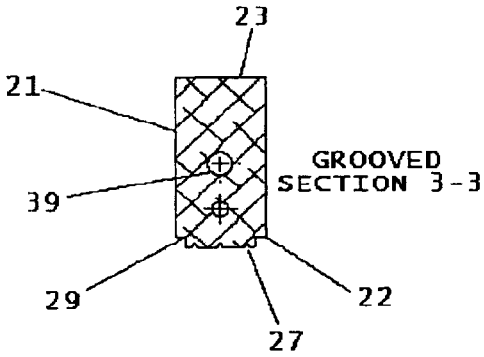
FIG. 3 is a cross sectional view along lines 3—3 of FIG. 2.
Figure 5:
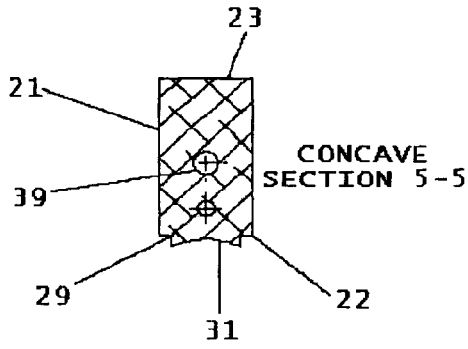
FIG. 5 is a cross-sectional view along lines 5—5 of FIG. 4.

Referring now to FIGS. 2 and 3 a knife 21 in accordance with this invention is shown. The surface 22 of the knife 21, shown in FIG. 2, heats the wax runner 13. The surface 23 of the knife 21 contacts the wax pattern gates 14. FIGS. 2 and 3 show the surface 22 of a knife 21 for contacting the wax runner 13 which surface 22 is formed with three v-shaped grooves 27 in it. Two of the grooves 27 are close to the edge 29 of the surface 22 which contacts the wax runners 13 and are v-shaped grooves 27 is located generally equally between the two v-shaped grooves 27 and to the edges 29. In FIGS. 4 and 5, there is shown a variation to the configuration of FIGS. 2 and 3, namely a concave surface 31 extending across the width of the surface 22 of the knife 21 in contact with the wax runner 13.

The cross sections shown in FIGS. 3 and 5 are just two of numerous possibilities. The exact configuration is not vital. The common feature of both FIG. 3 and FIG. 5 is to provide a space in the knife 21 into which molten wax will flow when the knife 21 is pressed against the wax runner 13. With a knife 21 having a surface 22 which is flat, the molten wax is forced outwardly which readily can result in the undesirable condition of molten wax flowing over the sides 33 of the wax runner 13. By having at least a portion of the surface 22 between the edges 29 of the knife 21 recessed or withdrawn slightly away from the wax runner 13, a space is provided to receive molten wax while retaining that molten wax under the knife 21. Thus, the v-shaped grooves 27 of FIG. 2 and FIG. 3 as well as the concave surface 31 as shown in FIG. 4 and FIG. 5 provide a space where melted wax can be held to prevent that wax from flowing over the sides of the wax runner 13.

Figure 6:
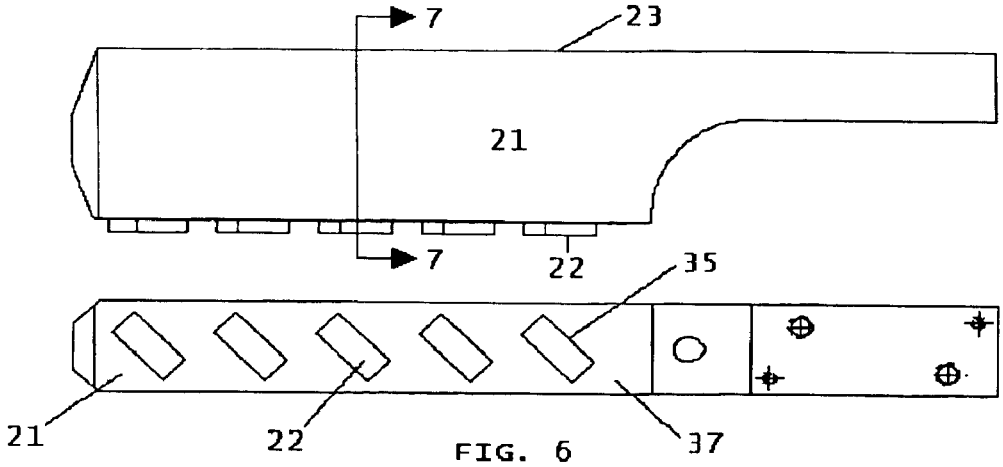
FIG. 6 is a plan view of the base of a knife having conformal heating surfaces.
Figure 8:
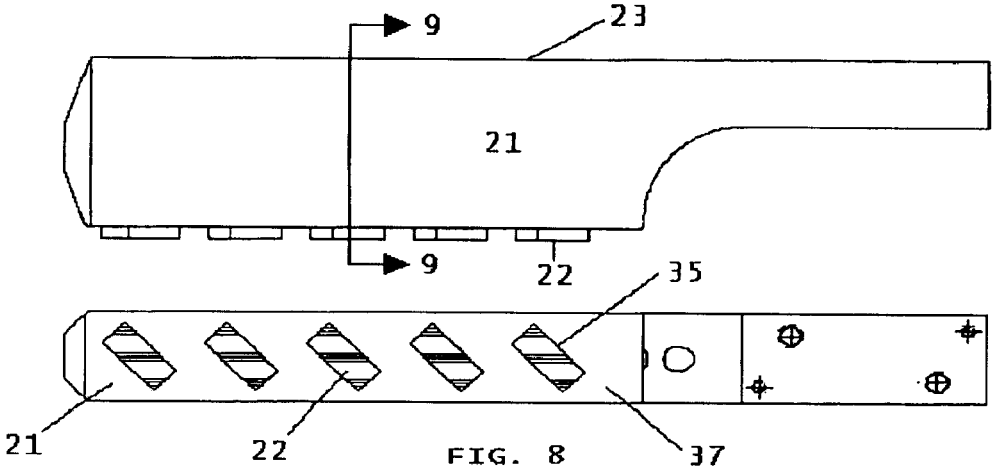
FIG. 8 is a plan view of the base of a knife having conformal heating surfaces with grooves in the surfaces.
Figure 7:
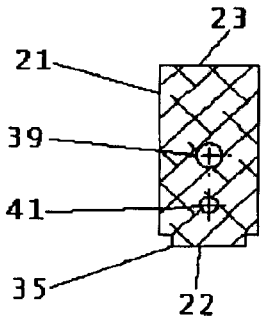
FIG. 7 is a cross-sectional view along lines 7—7 FIG. 6.

In FIGS. 6 and 7 and FIGS. 8 and 9 conformal surfaces 35 are shown. In FIGS. 6 and 7 the conformal surfaces 35 are flat while in FIGS. 8 and 9 the conformal surfaces 35 have grooves 36. The conformal surfaces 35 protrude slightly beyond a base surface 37 of the knife 21. The grooves 36 provide the space for molten wax to be held further to avoid wax running over the sides of the wax runner 13 as has previously been explained. With conformal surfaces 35, the wax runner 13 is heated only in the area where the wax pattern gates 23 are to be connected the wax runner 13. The configuration of the conformal surfaces are designed to conform to the shape of the wax pattern gate 14 to be fused to the wax runner 13. The polygram configuration of the conformal surface 35 shown in FIGS. 6 and 8 is merely illustrative. The conformal surface 35 eliminates melting for substantially the length of the wax runner thereby melting less wax and as a result, reducing the possibility of wax running over the side of the wax runner 13 due to a reduction in the area of the wax runner 13 that is heated. As a result there is an elimination of any flow of wax where heating is not required.

Figure 9:
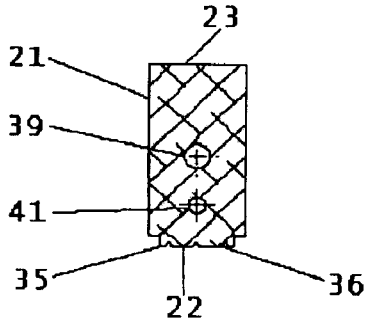
FIG. 9 is a cross-sectional view along lines 9—9 of FIG. 8.
Figure 10:
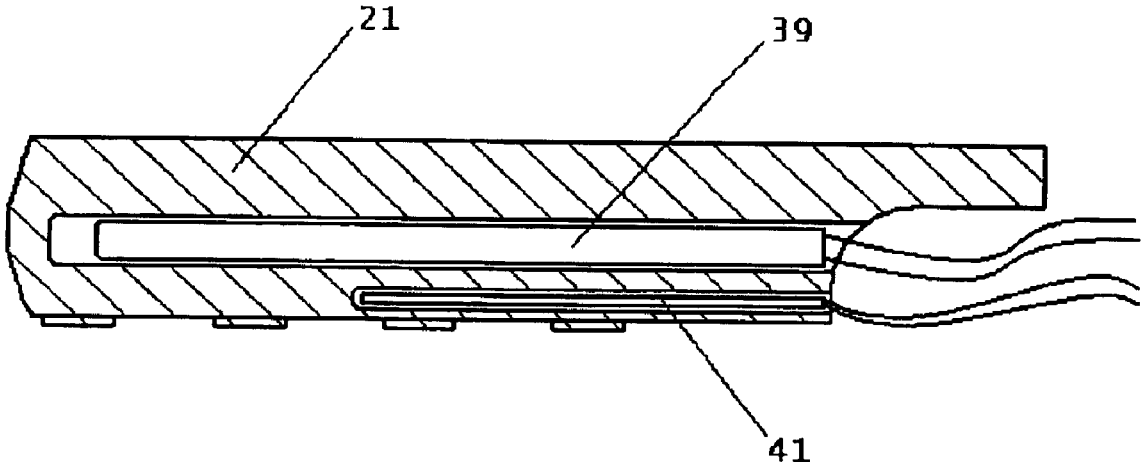
FIG. 10 is a cross-sectional view of the knife shown in FIG. 1 showing the heating element and a temperature sensor in the blade.

As can be seen in FIGS. 7, 9 and 10, a heating element 39 is located in the knives 21. The heating element 39 is controlled by a temperature sensor 41 (FIG. 10) also located in the knife 21, which determines the temperature of the knife 21. As a result, the melting temperature of the wax is controlled. The flash temperature of wax, generally speaking, is about five hundred degrees Fahrenheit. At the flash temperature volatilities, which are undesirable, are emitted into the atmosphere. By use of the electrical control system show in FIG. 11, the knife 21 is held to a temperature under the flash point and the attachment of the wax pattern gate 14 to the wax runner 13 is accomplished without undesirable volatilities being released into the atmosphere.

Figure 11:
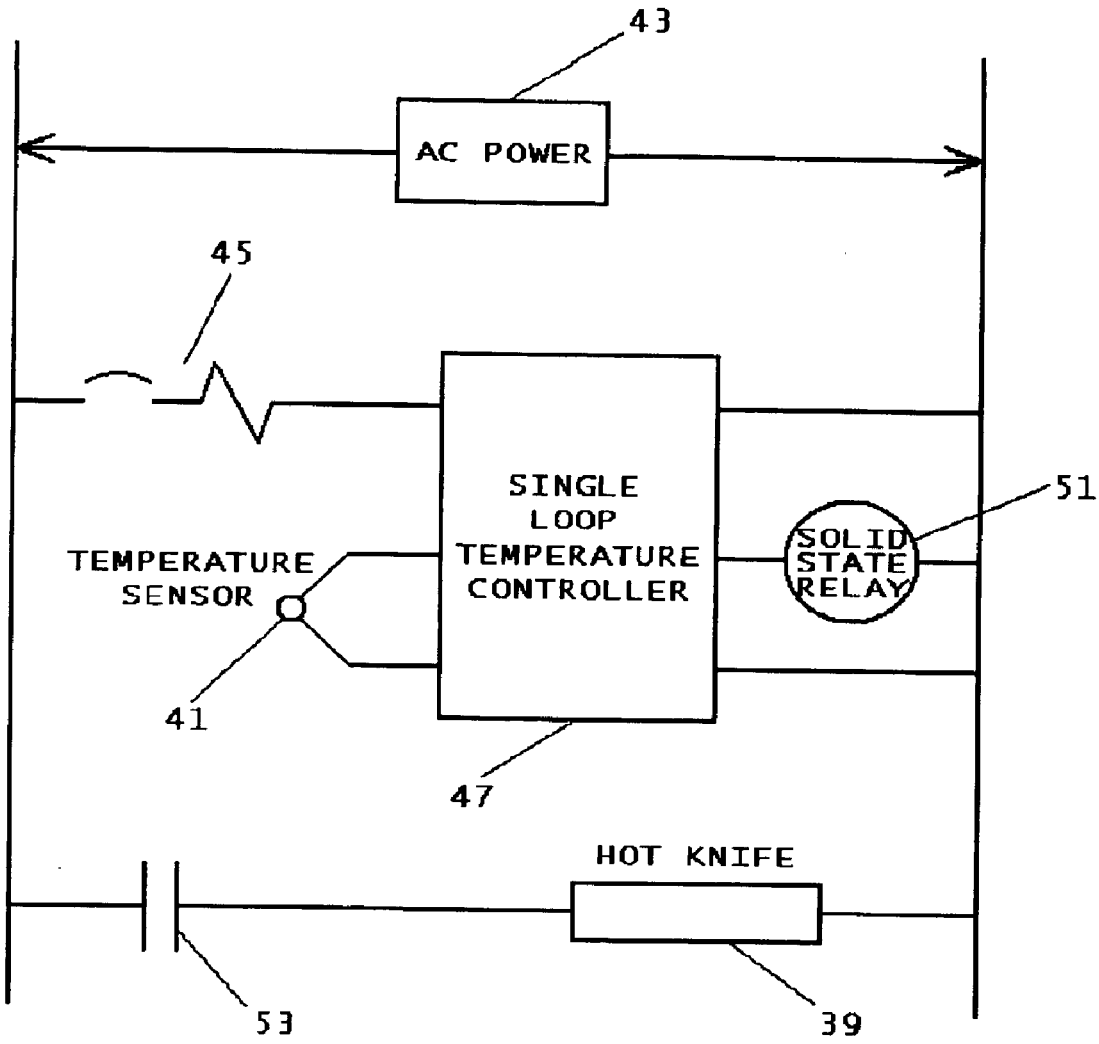
FIG. 11 is a circuit diagram for the controlled heating of the knife.

Referring to FIG. 11, which is an electrical circuit diagram for the heating element 39 in the knife 21. An alternating current power supply 43 is required. The power supply 43 is fed through a circuit breaker 45 into a temperature controller 47 which is activated by the temperature sensor 41. When the temperature controller 47 detects a specified level of temperature in the knife 21, it breaks the supply of power to the heating element 39 through a solid state relay 51 which opens and closes a solid state contact 53 in series with the heating element 39.

It is to be understood that the drawings and description matter are in all cases to be interpreted as merely illustrative of the principle of the invention, rather than as limiting the same in any way, since it is contemplated that various changes may be made in various elements to achieve like results without departing from the spirit of the invention or the scope of the appended claims.

What is claimed is:

1. A wax tree assembly knife having two opposite sides, the wax tree assembly knife comprising:

an elongated bar of heat conducting material having two opposed and generally parallel heating surfaces, one of the heating surfaces configured for contacting a pattern gate and another of the heating surfaces configured for contacting a wax runner, the heating surface configured for contacting the wax runner having two side edges and a center section between the two side edges, at least a portion of the center section being slightly closer to the heating surface configured for contacting the wax runner than the side edges and configured to provide a space for molten wax to be retained; and means for heating the elongated bar.

2. A wax tree assembly knife according to claim 1, wherein the center area is concave.

3. A wax tree assembly knife according to claim 1 wherein the center includes a plurality of grooves.

4. A wax tree assembly knife for producing molten wax on a pattern gate of at least one wax pattern and a portion of the surface of a wax runner, said wax tree assembly knife comprising:

an elongated bar of heat-conducting material having two opposed and generally parallel heating surfaces, one of the heating surfaces configured for contacting a pattern gate, and another of the heating surfaces configured for contacting a wax runner, the heating surface configured for contacting the wax runner having at least one raised area with a predetermined configuration and configured to provide a space for molten wax to be retained; and, means for heating the elongated bar.

5. A wax tree assembly knife according to claim 4 wherein the raised area has at least a portion that is grooved.

6. The wax tree assembly knife of claim 4 for producing molten wax on a pattern gate of at least one wax pattern and a portion of the surface of a wax runner, wherein the means for heating the elongated bar further comprises an electrical circuit with a heater, a temperature controller, a relay and a contact, the temperature controller activating the relay to open the contact.

7. A method of heating wax on a surface of a wax runner and wax on a surface of a pattern gate using a wax tree assembly knife having two opposite sides in preparation for fusing the pattern gate of a wax pattern to the wax runner, wherein the method comprises:

providing an elongated bar of heat conducting material having two opposed and generally parallel heating surfaces, one of the heating surfaces configured for contacting a pattern gate and another of the heating surfaces configured for contacting a wax runner, the heating surface configured for contacting the wax runner having two side edges and a center section between the two side edges, at least a portion of the center section being slightly closer to the heating surface configured for contacting the wax runner than the side edges and configured to provide a space for molten wax to be retained;

heating the elongated bar; and temporarily positioning the elongated bar between the pattern gate and the wax runner.

* * * * *